United States Patent [19]

Hanna

[11] 4,013,087

[45] Mar. 22, 1977

[54] DISPOSAL OF LIQUID EFFLUENT FROM SEWAGE TREATMENT PLANTS

[75] Inventor: Belah N. Hanna, Honolulu, Hawaii

[73] Assignee: Hanna Enterprises, Inc., Kailua, Hawaii

[22] Filed: Mar. 10, 1975

[21] Appl. No.: 556,928

[52] U.S. Cl. ..... 137/110; 137/567; 137/571; 137/599.1; 166/311; 210/205; 417/5

[51] Int. Cl.[2] ..... E03F 5/00

[58] Field of Search ..... 137/110, 209, 566, 567, 137/571, 599.1; 210/201, 205, 209, 104, 105, 265; 417/5, 6, 108; 166/311

[56] References Cited

UNITED STATES PATENTS

| | | | |
|---|---|---|---|
| 1,597,180 | 8/1926 | Crotto | 166/311 X |
| 2,204,703 | 6/1940 | Sanders | 210/205 X |
| 2,707,171 | 4/1955 | Miller | 210/265 X |
| 2,768,694 | 10/1956 | Moll et al. | 166/311 X |
| 3,060,950 | 10/1962 | Hijmans | 137/599.1 X |
| 3,396,102 | 8/1968 | Forrest | 210/241 X |
| 3,592,560 | 7/1971 | Mitchell | 417/108 X |
| 3,706,319 | 12/1972 | Neese et al. | 137/205 |
| 3,730,884 | 5/1973 | Burns et al. | 137/209 X |

*Primary Examiner*—Alan Cohan
*Assistant Examiner*—Gerald A. Michalsky
*Attorney, Agent, or Firm*—Boris Haskell

[57] ABSTRACT

Liquid effluent from a sewage treatment plant is injected into a disposal well by gravity feed, and alternatively by pressurized feed when the effluent load becomes too great for the gravity feed to handle, or when the gravity feed is slowed by the presence of solids in the effluent. The disposal well is reverse purged when necessary to remove obstructing solids.

17 Claims, 5 Drawing Figures

DISPOSAL OF LIQUID EFFLUENT FROM SEWAGE TREATMENT PLANTS

BACKGROUND AND SUMMARY OF INVENTION

The present invention relates generally to the handling of the liquid effluent from sewage treatment plants, and more particularly it relates to an effluent handling system for disposal wells.

One of the methods of disposing of the effluent of sewage treatment plants is to use sewage disposal wells. This method is applicable particularly in environments where the earth is porous and capable of carrying off large quantities of liquids. In recent years, this method of effluent disposal has been widely used in the State of Hawaii. However, two basic problems have been experienced in connection with these systems: The first problem is the need to handle varying loads, i.e. to handle varying rates of flow of effluent from the treatment plant. The second and more serious problem is that solids are sometimes carried over with the liquid effluent due to improper operation of the treatment plants, and these solids tend to clog the wells, causing them to malfunction or function inefficiently.

The present invention addresses both of these problems. In accordance with the present invention a feed system is provided for these disposal wells comprising a first or normal input, wherein the effluent is injected into the well by simple gravity feed. A second input is also provided, which is a pressurized feed, adapted to force the effluent into the well when the normal gravity injection is inadequate. The inadequacy of normal gravity injection may result either from an excessive rate of supply of the effluent from the treatment plant, or from a malfunctioning of the normal feed as may result from the presence of solids in the effluent. In addition, the present invention provides for the pressurized reverse purging of the wells, when necessary, to remove accumulated solids that may be blocking or slowing the feed of effluent into the well and its dispersion into the surrounding earth.

It is therefore one object of the present invention to provide for the injection of the liquid effluent from sewage treatment plants into disposal wells.

Another object of the present invention is to provide for the feeding of said effluent to said wells.

Another object of the invention is to provide for the injection of said effluent into said wells, either by gravity or by pressure, as required by the conditions of operation.

And still another object of the invention is to provide for the purging of said wells in order to clear them of accumulated solids, when necessary.

Other objects and advantages of the present invention will become apparent to those skilled in the art from a consideration of the subsequent detailed description of the invention.

DESCRIPTION OF DRAWINGS

The detailed description of the invention is had in conjunction with the accompanying drawings, in which like numerals refer to like or corresponding parts, and wherein.

DETAILED DESCRIPTION

The following detailed description is of one exemplary specific embodiment of the invention. It is intended only to be illustrative of the invention in order to facilitate a full understanding thereof.

Figure 1:
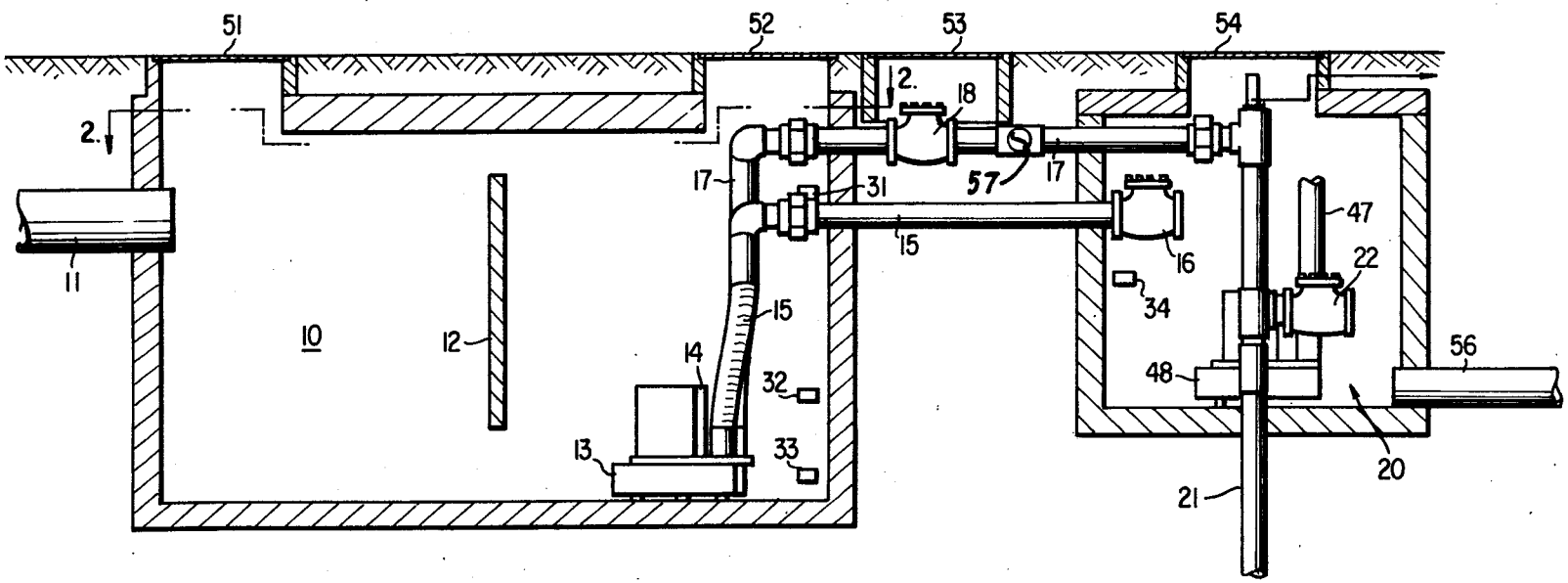
FIG. 1 is vertical sectional view of a system embodying the present invention.
Figure 2:
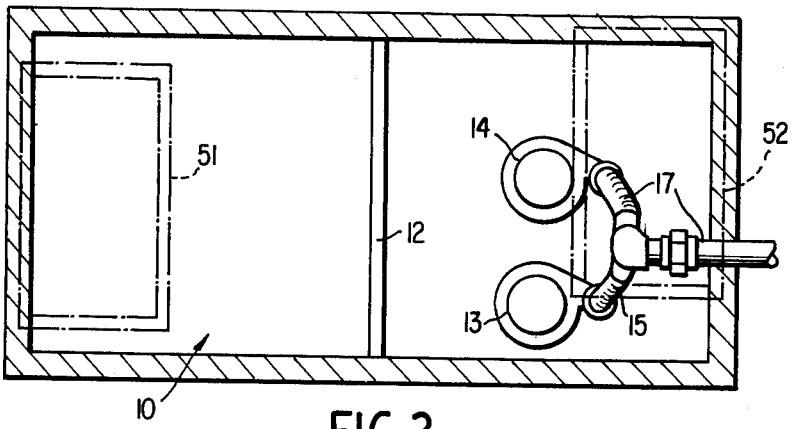
FIG. 2 is a top sectional view of a chlorine contact tank, which is a portion of FIG. 1, taken along the line 2—2 of FIG. 1.

Referring to FIG. 1, the numeral 10 designates a conventional chlorine contact tank for receiving the liquid effluent from a sewage treatment plant. The effluent is introduced into this tank by pipe 11, on one side of baffle 12. On the other side of the baffle are two pumps 13 and 14. A surge tank 20 is associated with the chlorine contact tank 10. Surge tank 20 surrounds the head of well casing 21 and the casing 21 penetrates into the earth to a disposal well. Normal feed from the chlorine contact tank 10 to the surge tank 20 could be simply by gravity, if tank 10 is located at a sufficiently higher elevation than tank 20. Otherwise, transfer pump 13 is provided, which pumps liquid from tank 10 through pipes 15, then through check valve 16, into the surge tank 20. This liquid accumulates in the surge tank until it reaches the height of check valve 22, and then flows by gravity through this check valve into the well casing 21, and thence into the disposal well in the earth.

Chlorine contact tank 10 also has a pressure pump 14, which feeds liquid under pressure from tank 10 through pipes 17 and check valve 18 directly into the well casing 21.

Chlorine contact tank 10 is provided with suitable liquid level control switches for operating the pumps 13 and 14. These are designated 31, 32 and 33. Under normal operation, when the liquid level in tank 10 reaches the level of switch 32, the transfer pump 13 is turned on, and it pumps liquid from tank 10, through pipes 15 and check valve 16 into surge tank 20. When the liquid level in tank 20 reaches the check valve 22, it flows by gravity into well casing 21 and thus into the disposal well. Should the capacity of transfer pump 13 be greater than the rate of feed into tank 10, the liquid level will drop, and when it reaches the level of switch 33, pump 13 is cut off until the liquid level again reaches switch 32.

If the rate of feed of effluent into tank 10 exceeds the capacity of pump 13, and if that condition prevails until the liquid level reaches switch 31, switch 31 cuts on pressure pump 14, to force liquid from tank 10 through pipes 17 and check valve 18 directly into well casing 21. Pump 14 continues to operate until the liquid level in tank 10 drops below the level of switch 33, at which time pump 14 is cut off.

A liquid level switch 34 is also located in surge tank 20 above the level of check valve 22. Should the liquid level in tank 20 rise to this point, switch 34 cuts off the transfer pump 13 and turns on the pump 14 (if it is not already turned on by action of switch 31).

The check valves 16 and 18 in lines 15 and 17 respectively are provided to permit liquid flow only in the direction of from the chlorine contact tank 10 to the surge tank 20, for reasons that will be described subsequently, Check valve 22 is designed in normal operation to permit liquid flow only from the surge tank 20 into the well casing 21. Thus, if solids in the well or casing cause the normal or gravity injection of liquid into the well through check valve 22 to become slow or inoperative, the liquid level in surge tank 20 will reach switch 34. When that condition prevails, transfer pump 13 becomes deactivated and remains inactive, and no further liquid will be introduced into the surge tank 20 until the liquid level drops below that of switch 34. Operation of the system will continue, however, by the activation of pressure pump 14 forcing liquid from the tank 10 directly into the well casing 21, overcoming the resistance of the solids in the well. Because check valve 22 permits liquid flow only from the surge tank 20 into the well casing 21, the pressure feed from pump 14 into well casing 21 does not cause any liquid to enter the surge tank 20.

Figure 5:
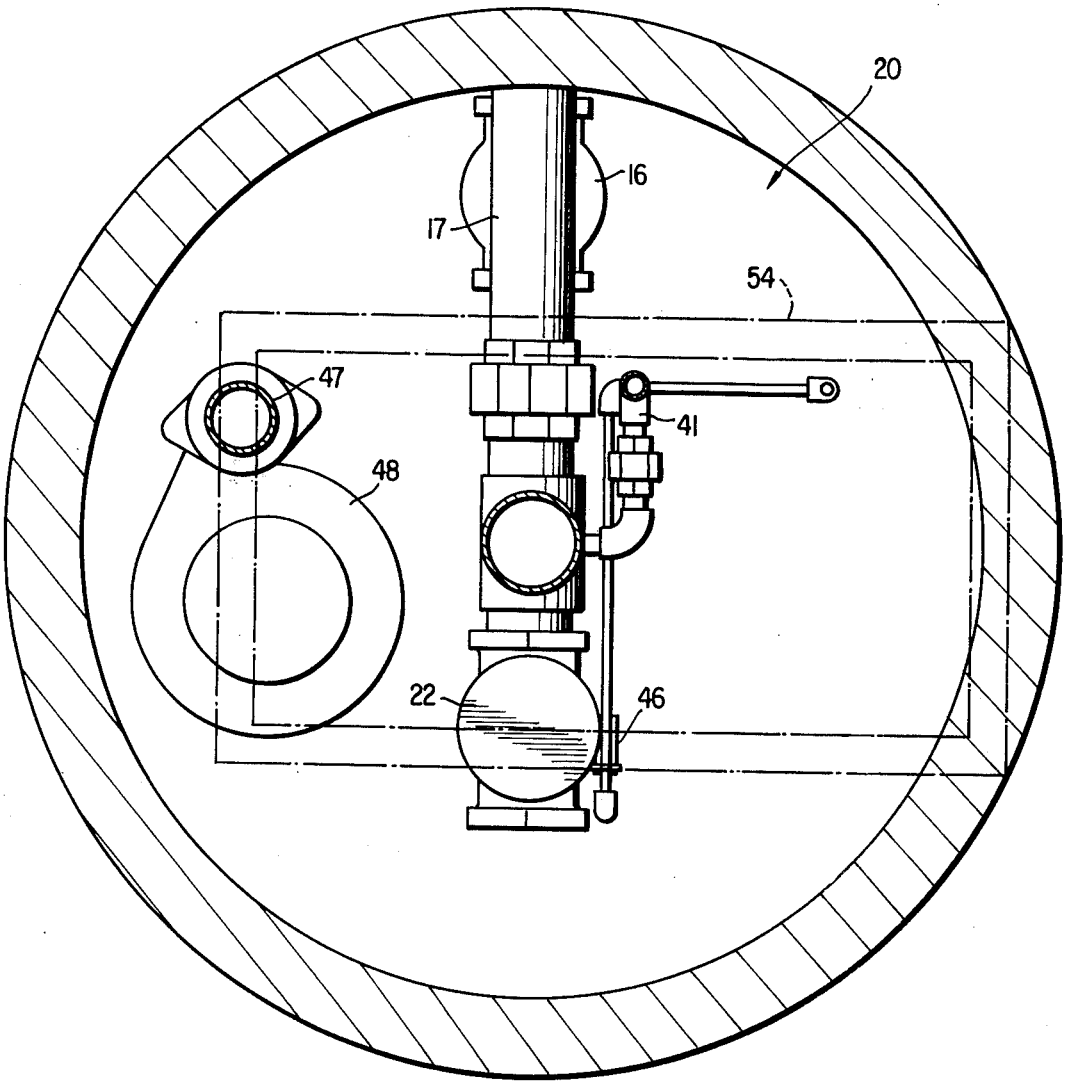
FIG. 5 is a top sectional view of the surge tank, taken along the line 5—5 of FIG. 4.
Figure 3:
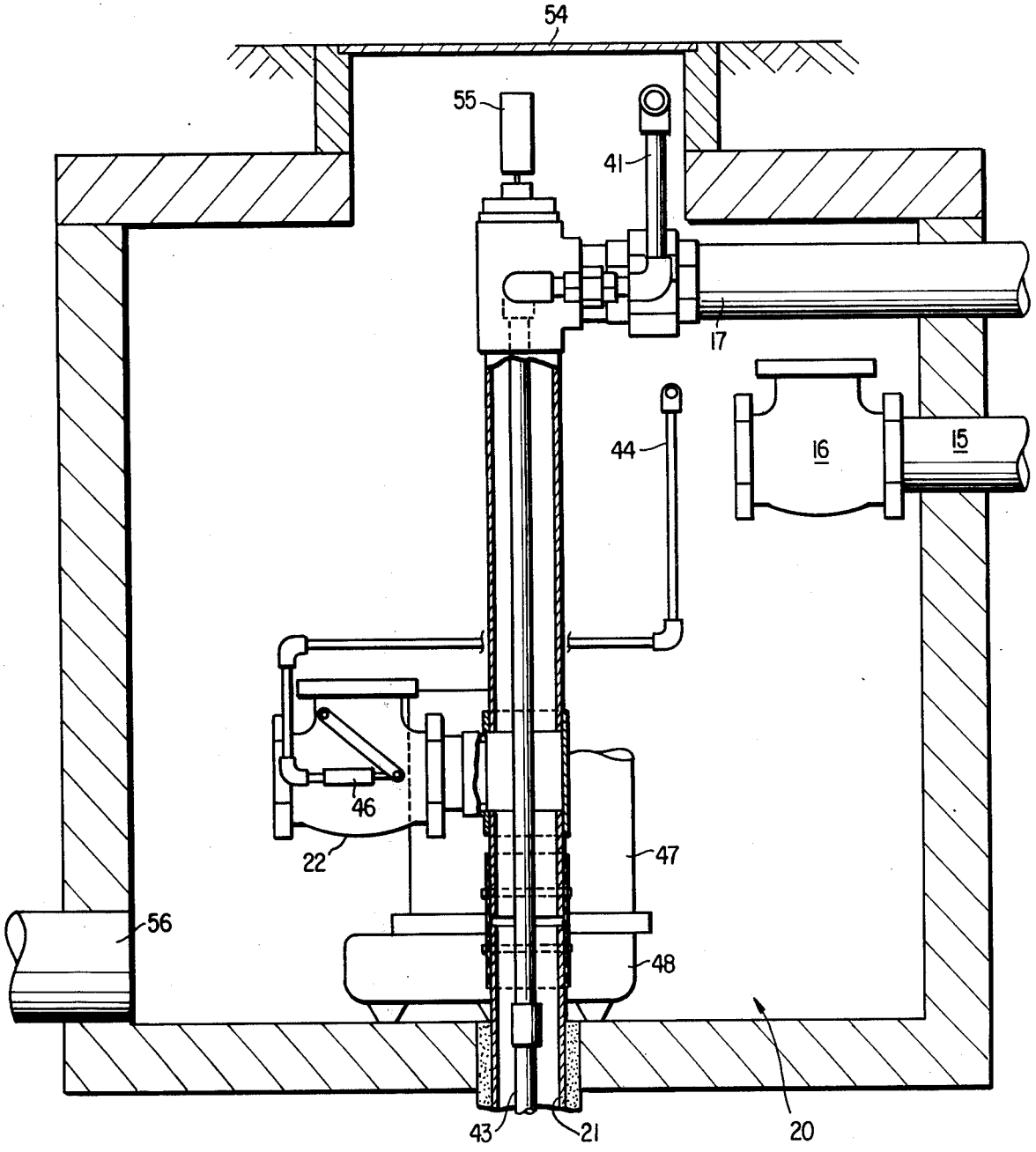
FIG. 3 is a detailed enlarged vertical sectional view of a surge tank, which is a portion of FIG. 1.
Figure 4:
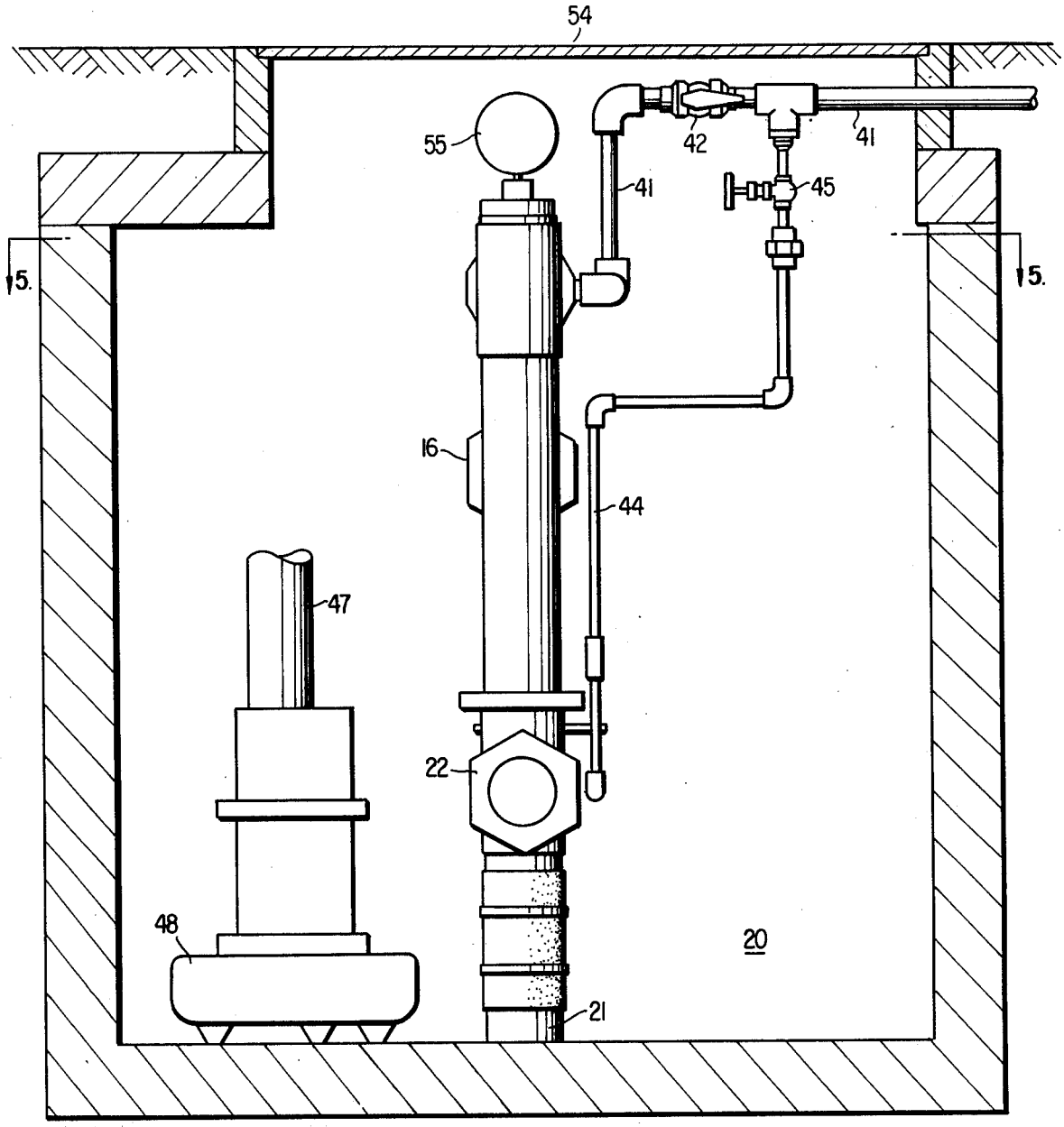
FIG. 4 is vertical sectional view of the surge tank of FIG. 3, taken from the left side as shown in FIG. 3.

The existence of the impediment to liquid flow into the disposal well cannot be tolerated for very long, particularly since the continued accumulation of solids could render the system totally inoperative. Accordingly, the system of the present invention provides for the periodic purging of the well and removal of solids. The purging system is shown in FIGS. 3, 4 and 5. Compressed air (or other gas) is fed from a compressor (not shown) through pipes 41 and adjustment or control valve 42, into pipe 43, which extends down the well casing 21 into the disposal well underground. During a slack period for the sewage disposal plant, or whenever it becomes necessary, the pumps 13 and 14 are turned off and compressed air is fed down pipe 43. At the same time, compressed air is fed through branch line 44 under control of valve 45 to pneumatic operator 46 for the check valve 22. Pressurizing of operator 46 forces check valve 22 to open and remain open. Thus, the compressed gas entering the well through pipe 43 causes a reverse flow up casing 21 and out through open check valve 22, thereby purging solids out of the well and casing and into the surge tank 20. Check valves 16 and 18 prevent reverse flow into chlorine contact tank 10 during this operation. The accumulation of liquids and solids in the surge tank 20 is removed by pump 48 and carried out by line 47 to any desired point, such as to the sewage treatment plant for further processing, or to an aeration or waste tank, or the like. Once the system is purged of solids, normal operation may be resumed as herein before described.

The basic system of the invention having thus been described, it is apparent that a number of refinements or modifications may be included. A number of removable access covers are usually provided, as shown at 51, 52, 53 and 54. A pressure gauge 55 may provide at the top of the well casing so the pressure in the well can be monitored during various phases of pressurized operation. A number of disposal wells may be operated in relatively close proximity to one another. In that case it may be desirable to provide an equalization line 56 interconnecting the respective surge tanks to balance the well loads. Similarly, the pressure feed from line 17 may be connected to the several wells, as suggested at 57, to equalize pressurized feed among the several wells and to distribute the pressurized feed for a clogged disposal well to adjacent operative wells until such time as the clogged well can be purged. Appropriate manual switches are normally provided to control the motors for the several pumps herein described, and appropriate electrical circuitry for implementing the above-described mode of operation is also provided. Since such switches and circuitry are obvious to one skilled in the art, they are not shown or described herein. If desired, the pneumatic reverse purging of the well may be effected automatically, such as be a clock, to take place once every twenty-four hours, for example during an established slow period.

Other variations and modifications will be apparent to those skilled in the art, and such as are embraced by the spirit and scope of the appended claims, are contemplated as within the purview of the present invention.

What is claimed is:

1. A system for the injection of the liquid effluent from a sewage treatment facility into a disposal well, comprising a first tank for accumulating said effluent, a second tank, means for feeding effluent from said first tank to said second tank, a well casing for said disposal well having an opening in said second tank, means for reverse pumping said well, additional pumping means for pumping effluent from said first tank directly into said well casing, and control means actuated by the effluent level in said second tank for stopping the feed of effluent by said feeding means and activating said additional pumping means.

2. A system as set forth in claim 1, and further including a check valve in said opening for permitting the gravity injection of effluent from said second tank into said well casing and preventing the feed of effluent injected into said well casing by said additional pumping means for feeding from said casing into said second tank.

3. A system as set forth in claim 1, wherein said reverse pumping means includes means for injecting pressurized fluid into said well to cause a reverse flow of material in said well casing upwardly through said casing into said second tank, and further including means for removing material from said second tank.

4. A system as set forth in claim 3, and further including a check valve in said opening for permitting the gravity injection of effluent from said second tank into said well casing and preventing the feed of effluent injected into said well casing by said additional pumping means from feeding from said casing into said second tank.

5. A system as set forth in claim 4, and further including means for holding said check valve open, to permit flow of material from said well casing into said second tank during said reverse pumping.

6. A system as set forth in claim 5, and further including additional check valves associated with the feeding means and additional pumping means for preventing the flow of material from said second tank and from said casing to said first tank.

7. A system for the injection of the liquid effluent from a sewage treatment plant into a disposal well, comprising a first tank for accumulating said effluent, a second tank, means for feeding effluent from said first tank to said second tank, a well casing for said disposal well having an opening in said second tank, means for reverse pumping said well, additional pumping means for pumping effluent from said first tank directly into said well casing, and means responsive to the level of effluent in said first tank for controlling the feeding means and additional pumping means.

8. A system for the injection of the liquid effluent from a sewage treatment plant into a disposal well, comprising a first tank for accumulating said effluent, a second tank, means for feeding effluent from said first tank to said second tank, a well casing for said disposal well having an opening in said second tank, means for reverse pumping said well including means for injecting pressurized fluid into said well to cause a reverse flow of material in said well casing upwardly through said casing into said second tank, means for removing material from said second tank, additional pumping means for pumping effluent from said first tank directly into said well casing, and means responsive to the level of effluent in said first tank for controlling the feeding means and additional pumping means.

9. A system as set forth in claim 8, and further including control means actuated by the effluent level in said second tank for stopping said feeding means and activating said additional pumping means.

10. In a system for the injection of liquid effluent from a sewage treatment facility into a disposal well, a tank for receiving said effluent, a well casing for said well having an opening to said tank for feeding said effluent down said casing and into said well by gravity, means for reverse pumping said well to force accumulated solid material up and out of said casing, additional pumping means connected to said casing for force pumping said effluent into said casing, a check valve for said opening permitting flow of material from said tank into said casing and preventing flow of material from said casing into said tank, and means for selectively overriding said check valve to permit flow of material from said casing into said tank during said reverse pumping.

11. In a system as set forth in claim 10, means actuated by the effluent level in said tank for controlling the activation of said additional pumping means.

12. In a system as set forth in claim 10, said reverse pumping means including means for injecting fluid under presure into said well to cause a reverse flow of material up and out of said casing.

13. In a system for the injection of liquid effluent from a sewage treatment facility into a disposal well, a tank for receiving said effluent, a well casing for said well having an opening to said tank for feeding said effluent down said casing and into said well by gravity, means for reverse pumping said well to force accumulated solid material up and out of said casing, additional pumping means connected to said casing for force pumping said effluent into said casing, and means actuated by the effluent level in said tank for controlling the activation of said additional pumping means.

14. A system for the injection of the liquid effluent from a sewage treatment plant into a disposal well, comprising a first tank for accumulating said effluent, a second tank, means for feeding effluent from said first tank to said second tank, a well casing for said disposal well having an opening in said second tank for receiving effluent from said second tank, means for reverse pumping said well including means for injecting pressurized fluid into said well to cause a reverse flow of material in said well casing upwardly through said casing into said second tank, means for removing said material from said second tank, and means inhibiting the flow of said material to said first tank during reverse pumping of said well.

15. In a system for the injection of liquid effluent from a sewage treatment facility into a disposal well in a porous stratum of the earth, a tank for receiving said effluent, a well casing for said well, means for conducting said effluent from said tank into said casing whereby said effluent is caused to flow down said casing into said well and there to be dispersed in the earth, means for reverse pumping said well to force accumulated solid material carried into said well and casing with said effluent up and out of said casing including means for feeding gas under pressure into said well to cause a reverse flow including said solid material up and out of said casing, and means inhibiting flow between said casing and tank during said reverse pumping of said well.

16. In a system as set forth in claim 15, means for removing said solid material pumped out of said casing during said reverse pumping from the environs of said well and casing to prevent reentry thereof into said well and casing.

17. In a system as set forth in claim 15, the last-mentioned means inhibiting flow from said casing to said tank.

* * * * *